US008684792B2

(12) United States Patent
Rocha

(10) Patent No.: US 8,684,792 B2
(45) Date of Patent: Apr. 1, 2014

(54) SANDING SYSTEM WITH VACUUM

(71) Applicant: Juan Rocha, Long Beach, CA (US)

(72) Inventor: Juan Rocha, Long Beach, CA (US)

( * ) Notice: Subject to any disclaimer, the term of this patent is extended or adjusted under 35 U.S.C. 154(b) by 0 days.

(21) Appl. No.: 13/873,140

(22) Filed: Apr. 29, 2013

(65) Prior Publication Data

US 2013/0267149 A1 Oct. 10, 2013

Related U.S. Application Data

(60) Provisional application No. 61/639,826, filed on Apr. 27, 2012, provisional application No. 61/650,387, filed on May 22, 2012.

(51) Int. Cl.
*B24B 23/00* (2006.01)
*B24B 55/10* (2006.01)

(52) U.S. Cl.
USPC ..... 451/28; 451/354; 451/456; 451/523

(58) Field of Classification Search
USPC ..... 451/354, 356, 451, 456, 523, 524, 525, 451/28
See application file for complete search history.

(56) References Cited

U.S. PATENT DOCUMENTS 4,697,389 A 10/1987 Romine
5,245,797 A * 9/1993 Milkie ..... 451/354
D344,003 S * 2/1994 Milkie ..... D8/90
5,540,616 A * 7/1996 Thayer ..... 451/354
6,971,952 B2 12/2005 Whitty
6,988,940 B1 * 1/2006 Taylor ..... 451/354
7,033,259 B1 * 4/2006 Seasholtz et al. ..... 451/354
7,364,500 B2 * 4/2008 Brown ..... 451/523
8,348,726 B2 * 1/2013 Brunner ..... 451/451

OTHER PUBLICATIONS

Stanley Pro Series Drywall Sander Case Pack 12; http://koosey.com; downloaded Jun. 26, 2013, 3:06 PM PT.
Perma Glas-Mesh SV303U Vacuum Drywall Hand Sander; http://www.walmart.com; downloaded Jun. 26, 2013, 3:21 PM PT.
Dustless Turbo Drywall Sander; http://dustlesstools.com; downloaded Jun. 27, 2013, 2:07 PM PT.
Dust-Free Drywall Hand Sander Kit with 6-foot hose; http://www.hydetools.com; downloaded Jun. 26, 2013, 2:59 PM PT.
Stanley ProSeries Dust Free Sanding Kit 26-031 Hose Adapters for Shop Vacuum; http://www.ebay.com/itm/300913752096; downloaded Jul. 2, 2013 at 5:47 PM PST.

* cited by examiner

*Primary Examiner* — Timothy V Eley
(74) *Attorney, Agent, or Firm* — George P. White

(57) ABSTRACT

A sanding system suitable for drywall sanding has a foam sanding block that fits into a hollow housing such that a gap is left around most of the perimeter of the sanding block and the housing near the plane of sanding. Some regions of the perimeter are dimensioned relative to the sanding block such as to not leave a gap but instead are such as to provide a friction fit between the housing and the sanding block.

15 Claims, 14 Drawing Sheets

FIG. 13
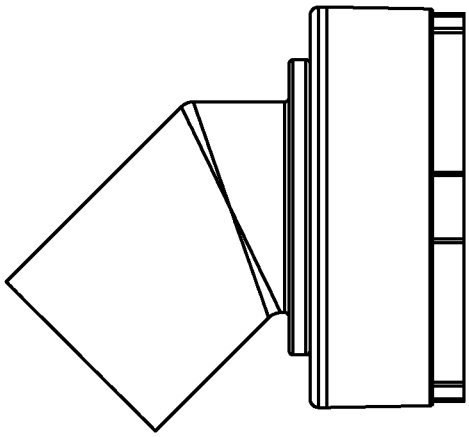
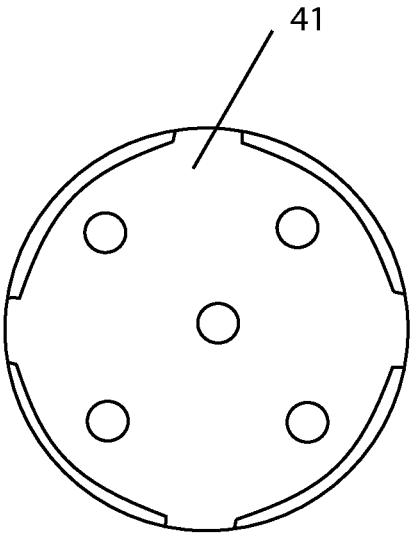
FIG. 14A
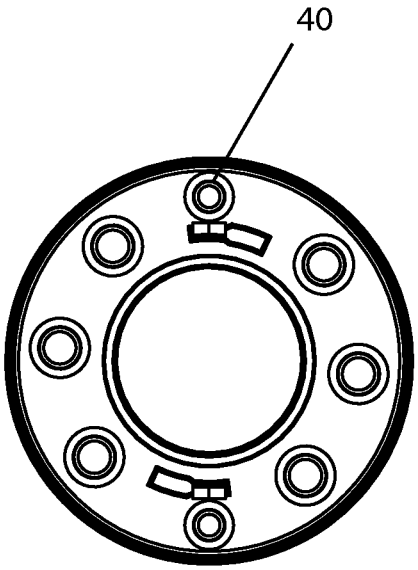
FIG. 14B

SANDING SYSTEM WITH VACUUM

RELATED APPLICATIONS

This application claims the benefit of Provisional Patent Application No. 61/639,826 filed Apr. 27, 2012, and Provisional Patent Application No. 61/650,387, filed on May 22, 2012.

FIELD

This disclosure is in the field of sanding systems and accessories.

BACKGROUND

Sanding accessories might be divided into those that are for hand sanding and those that are for power sanding. Power sanding devices often include a vacuum system to remove the dust and debris that arise from the sanding and abrading process. Some systems for aiding in a hand sanding process also have vacuum systems or vacuum attachment points. An issue with these systems can be how the vacuum suction is applied to the region of sanding without interfering with the sanding process but still removing a significant portion of the dust.

SUMMARY

A sanding block can fit into a complementary shaped housing. If portions of the perimeter of the housing are slightly oversized in comparison to the perimeter of the sanding block a gap can exist between a sanding block portion and the adjacent sidewall portion of the housing. The generally hollow housing can form an enclosure for the sanding block and also have an attachment point for a vacuum source such as the rigid hose of a vacuum designed for handy-man work. This can produce a negative air pressure in the perimetrical gap between the sanding block and the housing. Dust created by the sanding process can be removed by this negative air pressure that essentially surrounds the planar sanding surface. In some embodiments a long rigid extension of a vacuum not only delivers the negative pressure but also acts as an extended handle to reach higher or farther locations.

Some housings have an inner structure that is a plate with gaps that allow airflow while also providing a mechanical backing for a non-rigid sanding block. In other versions the sanding block is backed by an array of individual protrusions rather than a plate.

BRIEF DESCRIPTION OF THE DRAWINGS

FIG. 13 is a side view of a third embodiment holder;

FIG. 14A is a bottom view of the sanding block holder of FIG. 13 with a plate;

FIG. 14B is a bottom view of the sanding block holder of FIG. 13 with multiple individual protrusions;

DETAILED DESCRIPTION

Sanding can be a very dirty endeavor. By its nature a surface is being modified by the removal of material. That removed material can be a very fine dust in the case of drywall sanding. Drywall sanding is typically done by hand and due to the heights that may be involved the sanding surface is frequently attached to a handle. The problem of collecting a majority of the dust created in drywall sanding is solved by a housing and a complementary sanding block that fits into the housing leaving a gap between portions of the perimeter of the sanding block and the inner edge of the housing. A vacuum source is attached to the top of the housing and negative air pressure is directed to a region including the gap.

In some embodiments the portion of the vacuum conduit proximate to the housing can be a rigid section. Depending on its length and the area to be sanded, this portion can also function as the primary handle for the sanding. The sanding block is a material such as that of a Hyde Tools brand model 45310 Foam Sanding Block.

In order to secure the sanding block in the housing and maintain a gap around an effective majority of the perimeter of the sanding block some embodiments provide for an interference fit between a foam sanding block and the housing opening at select locations. In many shown embodiments these locations include the corners.

In some embodiments the housing may be an existing somewhat standard vacuum accessory and the vacuum conduit a standard vacuum rigid extension pipe. In others the housing may be of a shape and configuration not normally found as a vacuum accessory but rather shaped to achieve a sanding goal. One case is a triangular shaped housing and sanding block for reaching into a corner of a wall.

Testing has shown this to be a very effective system with a gap of between about ⅛ inch and ⅜ inches. Testing with a prototype showed very effective performance at 3/16 inch for that particular unit.

First Embodiment

Figure 1:
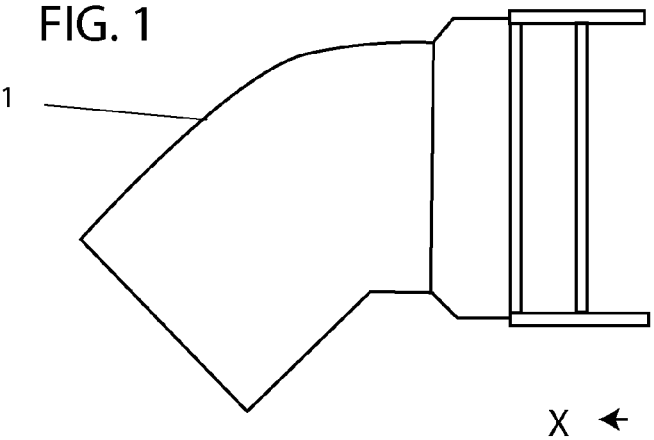
FIG. 1 shows a side view of a first embodiment of a rectangular sanding block holder along the short side.
Figure 2:
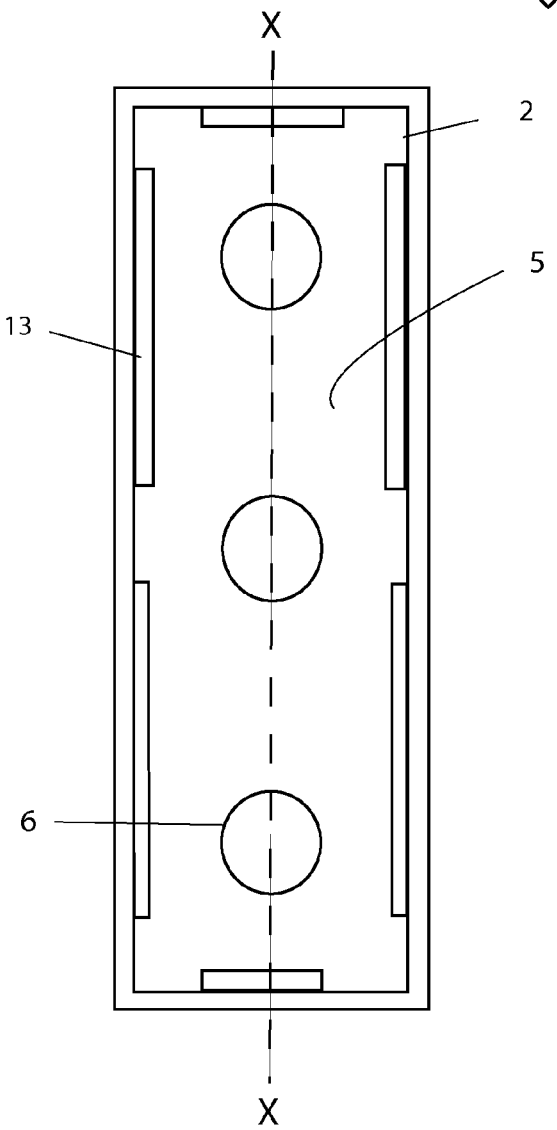
FIG. 2 shows a bottom view of the first embodiment holder.
Figure 3:
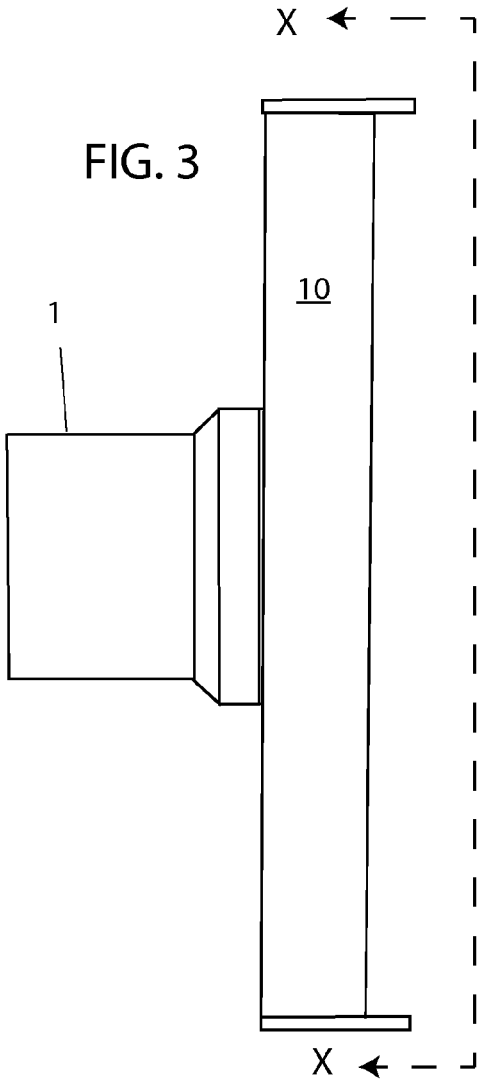
FIG. 3 shows a side view of the first embodiment holder along the long side.
Figure 4:
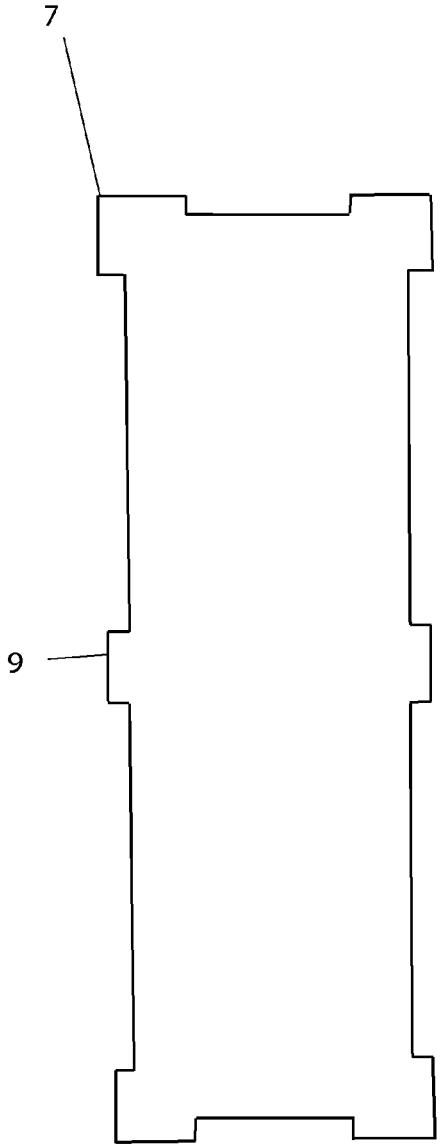
FIG. 4 is a bottom view of a sanding block suitable for use with the first embodiment holder.

As seen in FIGS. 1-9 a sanding block holder has a housing 10 with a rectangular bottom opening with an arced top vacuum hose attachment point 1. FIG. 2 shows a bottom view that illustrates a support plate 5 with three holes 6 in the housing. That figure also shows the inner perimeter of the housing having rectangular shape to accommodate a sanding block shape as shown in FIG. 4.

FIG. 4 shows a foam sanding block with a complementary shape to that of the bottom of the housing. When mated, there will be a gap 13 between the perimeter of the housing and the sanding block along the sanding block's outline except at the corners 2 and at regions in the long sides 9. The long sides of the sanding block have a tab 9 to create a friction fit or interference fit with the housing as well as complementary corner structures 7.

Figure 5:
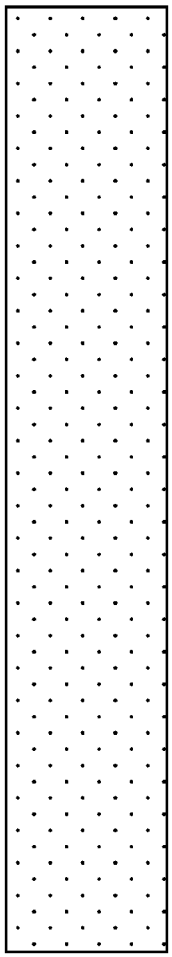
FIG. 5 is a side view of the sanding block of FIG. 4.
Figure 6A:
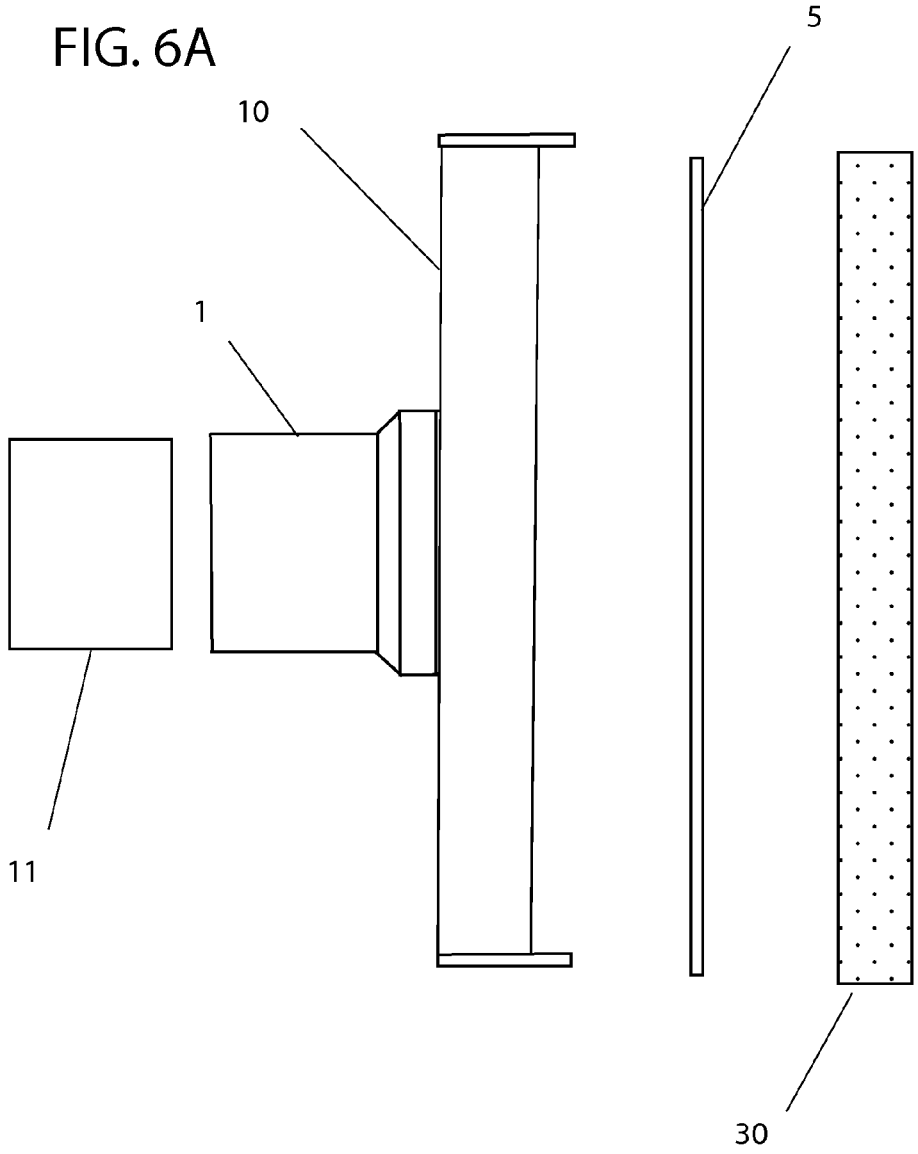
FIG. 6A is an exploded view of the first embodiment holder with the sanding block of FIG. 4.

FIG. 5 shows a side view of the sanding block. Its corners 7 fit into the corners of the housing. Suitable sanding blocks include a foam body with an abrasive surface. The foam in this material is somewhat resilient and when pushed into the housing will slightly deform and then spring back exerting a lateral force on the housing. In this sense it might be thought of as a spring fit. The housing has a planar inner structure 5 with three holes 6. This planar structure can distribute the negative air pressure and act as a backing for the foam sanding block. In FIG. 6A an exploded view is seen that includes the sanding holder and a sanding block. It shows a portion of a connecting pipe 11, a vacuum connector 1 and the housing 10. Exploded out from the housing is the flat support plate 5.

Figure 6B:
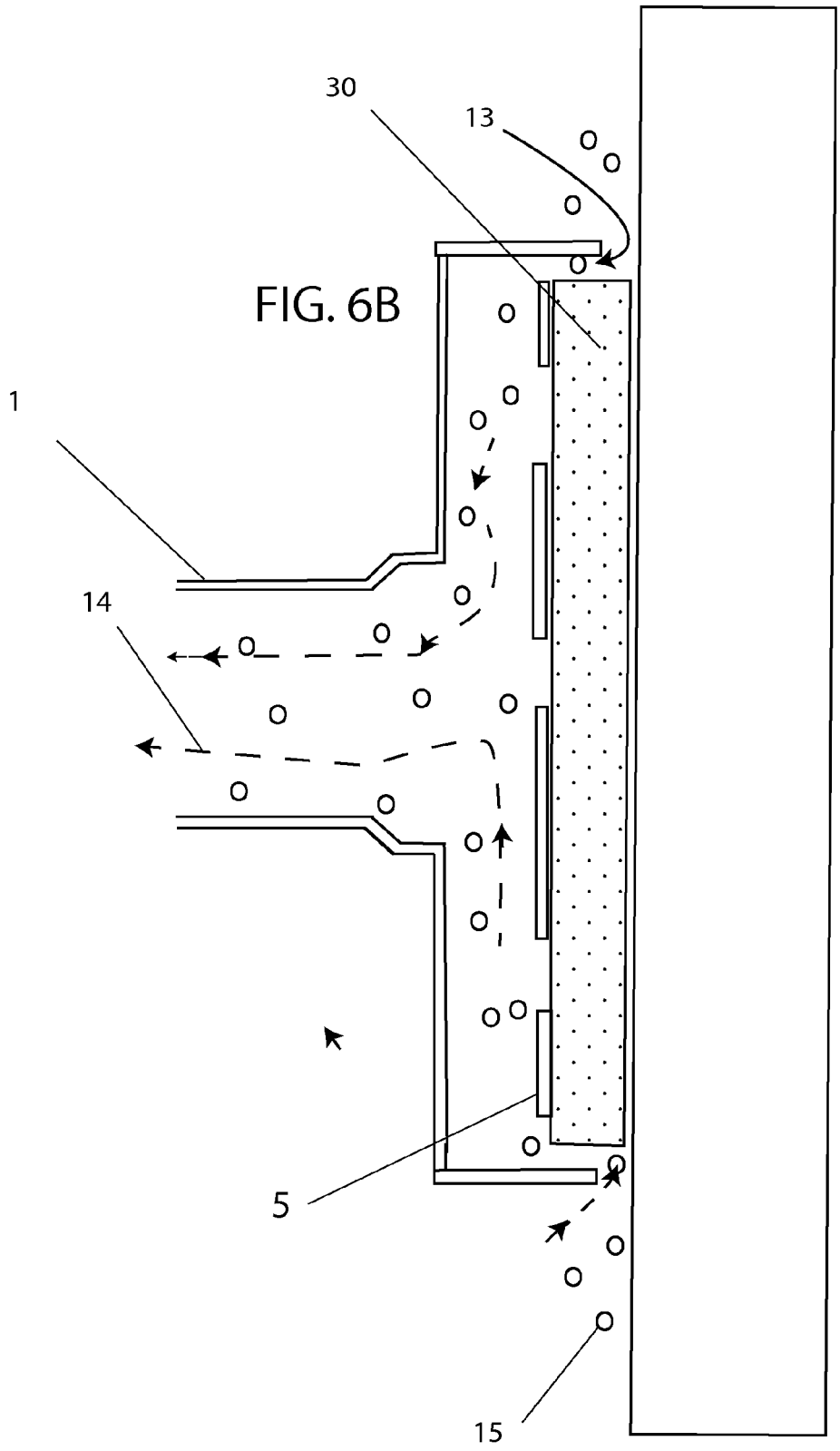
FIG. 6B is a sectional view of the first embodiment along the line X-X that shows airflow patterns.
Figure 7A:
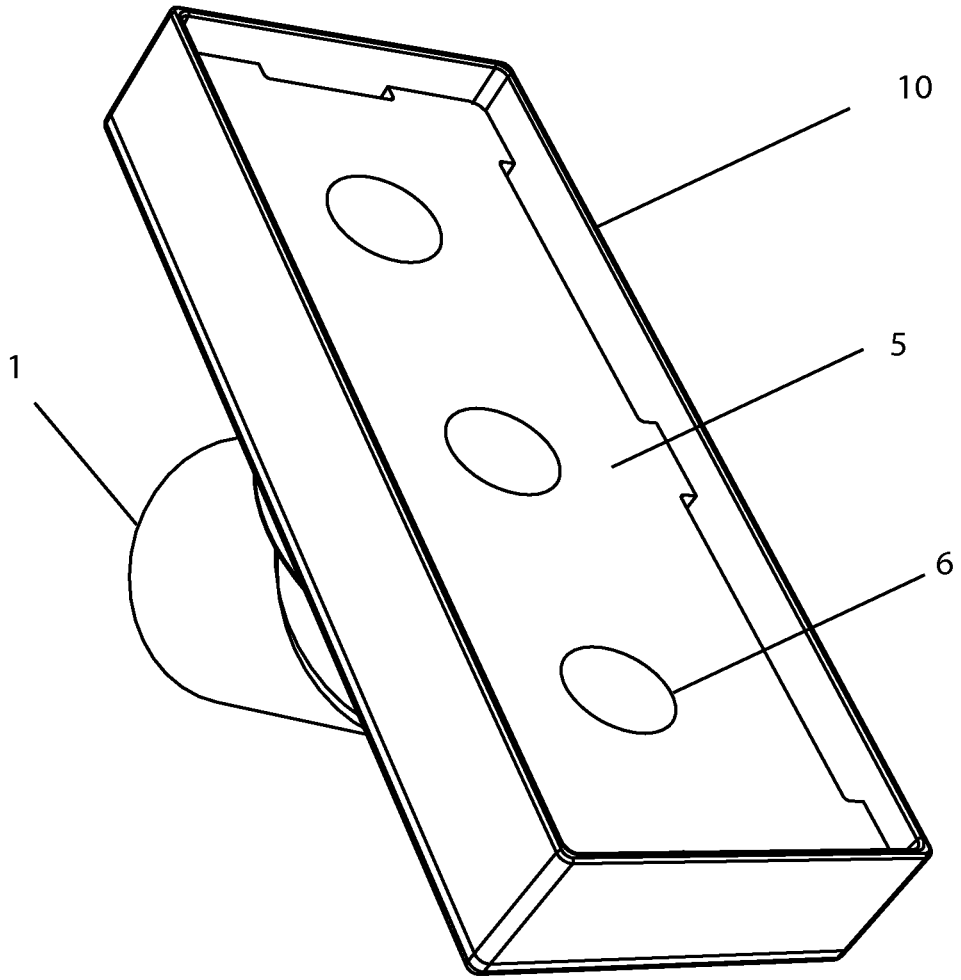
FIG. 7A is a bottom perspective view of the first holder embodiment.
Figure 7B:
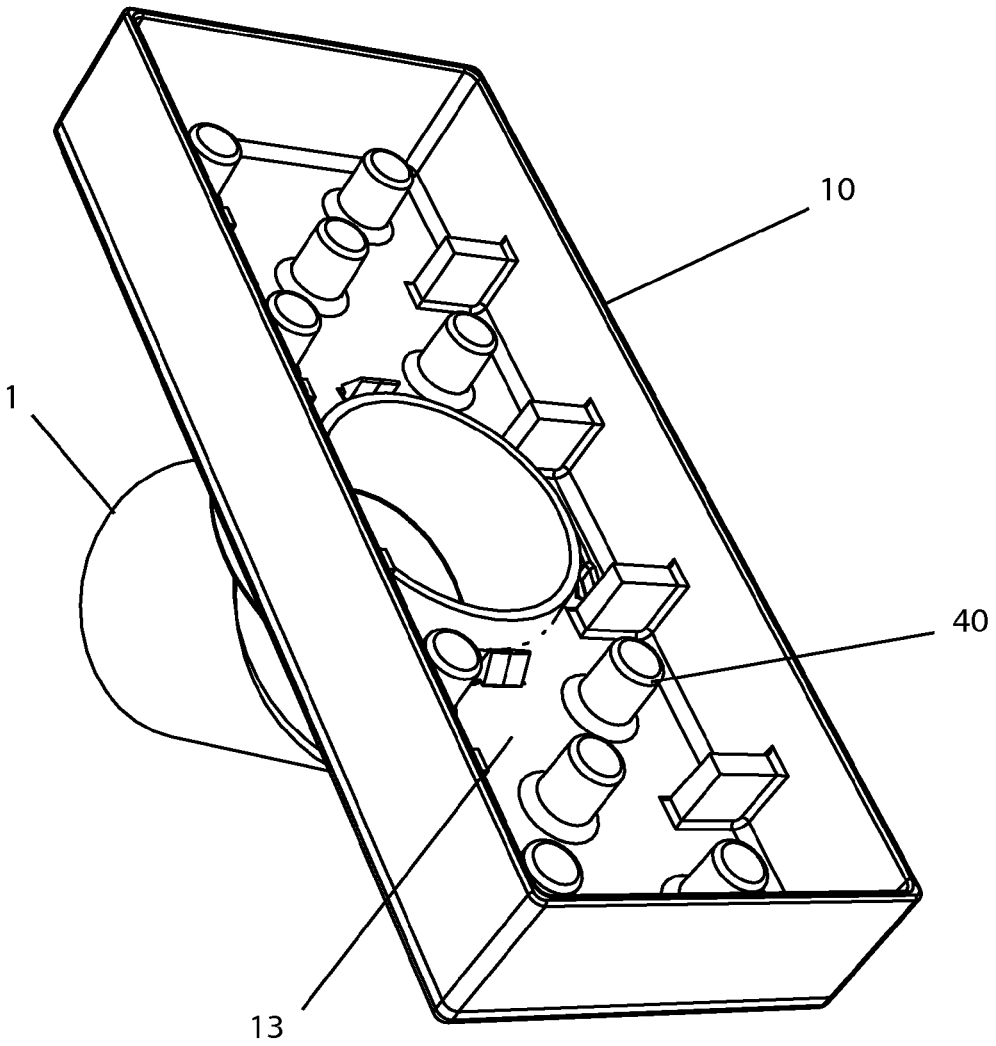
FIG. 7B is a bottom perspective view of a variation of the first holder embodiment that has multiple individual protrusions rather than a plate.
Figure 8:
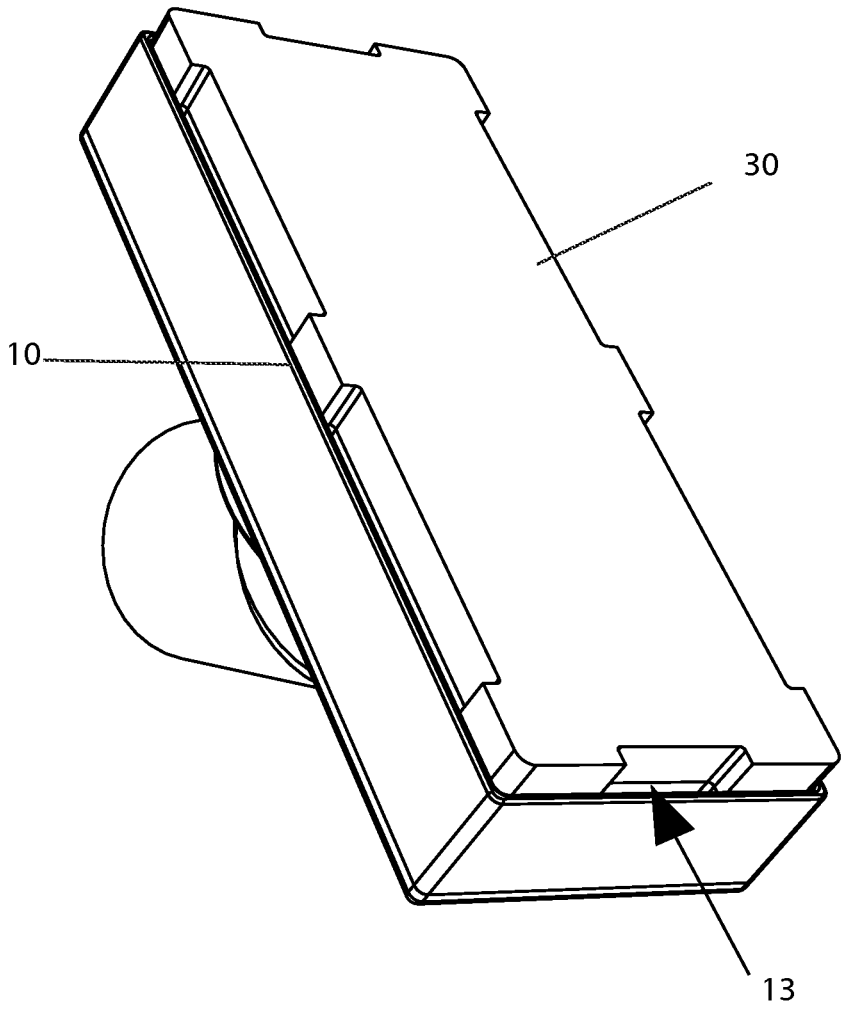
FIG. 8 is the unit and view of FIG. 7 or FIG. 7A with a sanding block installed.
Figure 9:
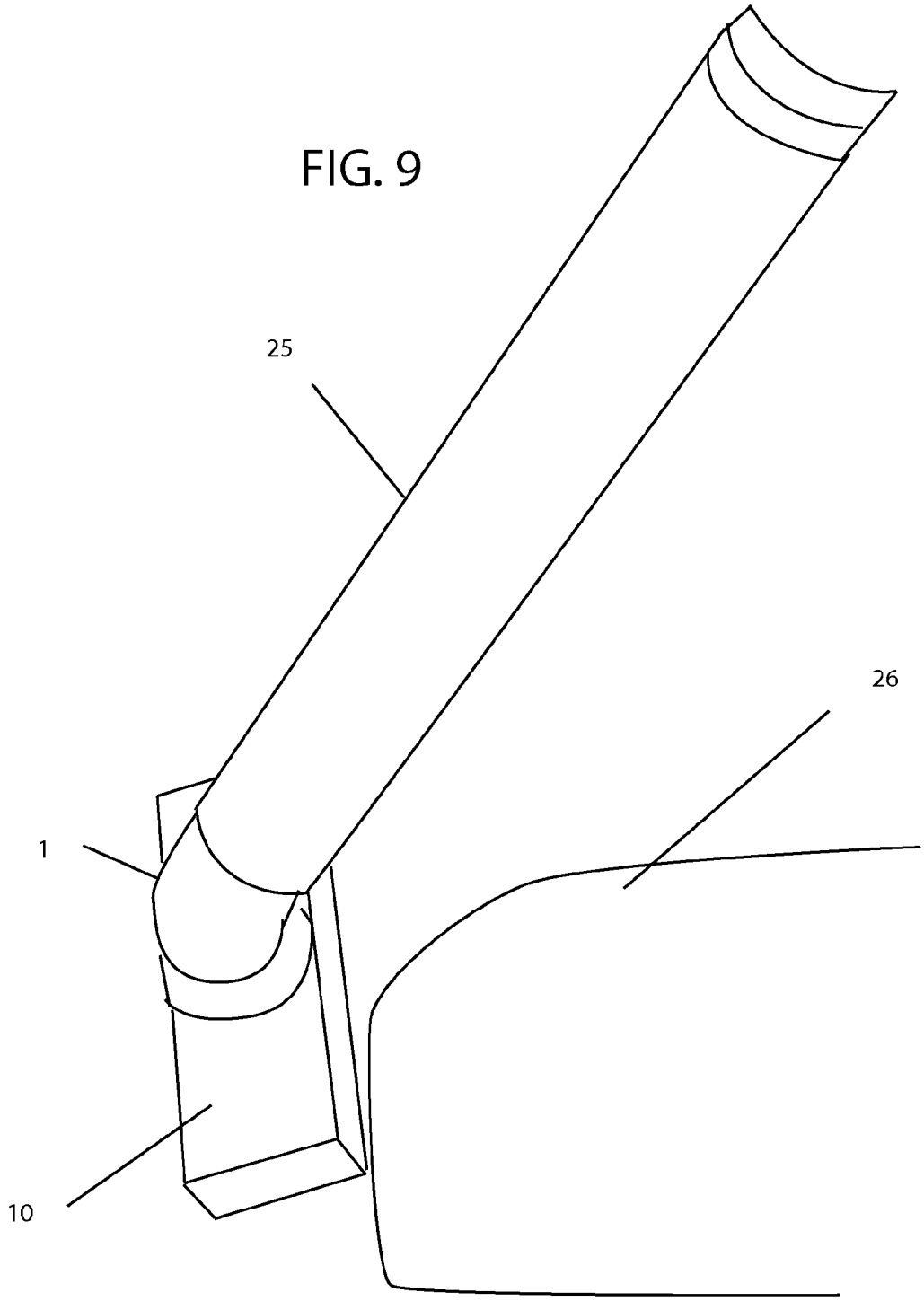
FIG. 9 shows the first embodiment holder with a rigid vacuum attachment in use.

FIG. 6B shows a sectional view of this first embodiment along the line X-X. Is shows the path of airflow 14 bringing dust 15 particles into the housing. FIGS. 7A and 8 respectively, show a perspective view of the unit from the bottom without and with a sanding block installed. FIG. 7B shows the bottom of an alternate version with several individual cylindrical protrusions 40 acting as a supporting structure rather than a plate. FIG. 9 illustrates the use of the unit with a rigid pipe 25 acting as a handle in creating a sanded region 26.

Embodiments Two, Three, Four and Five

Figure 10:
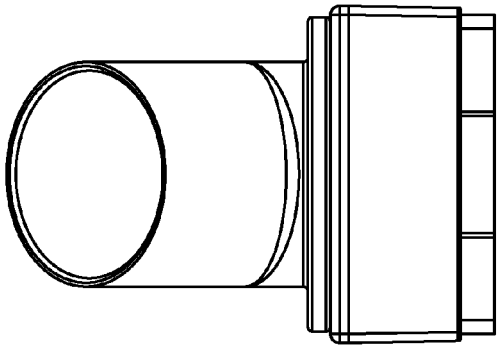
FIG. 10. is a side view of a second sanding block holder.
Figure 11:
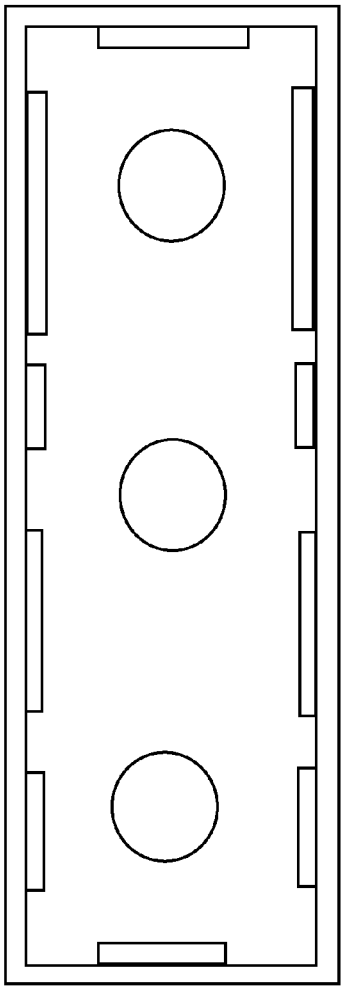
FIG. 11. shows a bottom view of the second embodiment holder.
Figure 12:
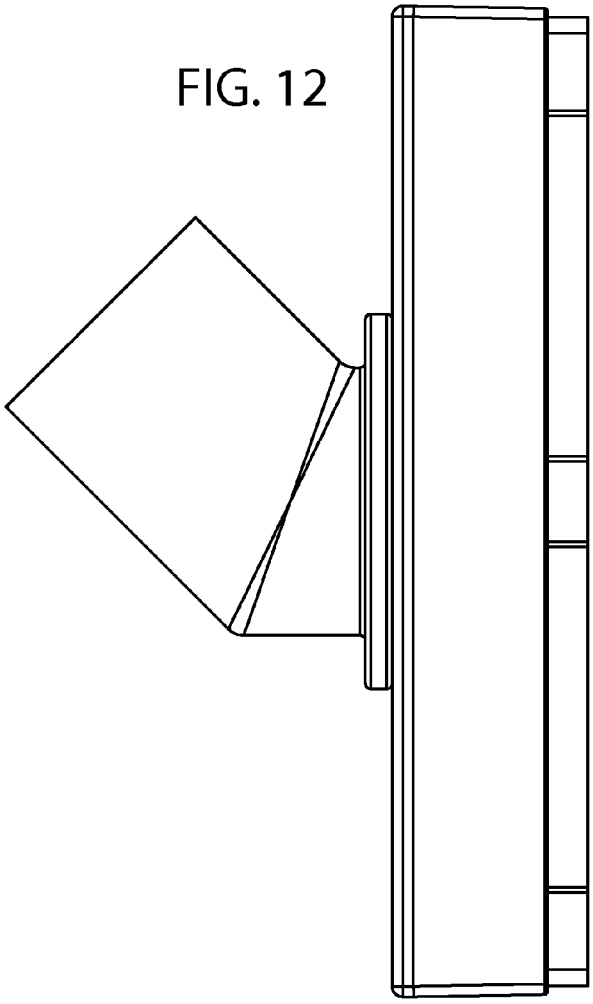
FIG. 12 shows the top view of the second embodiment holder.

Other embodiments shown in the drawings are similar to the first embodiment but have different shapes, sizes and friction fit regions. The second embodiment seen in FIGS. 10, 11, and 12 can be thought of as the first embodiment housing with the curved vacuum attachment pipe turned 90-degrees. This would provide a vertically oriented sanding surface. If that were the only change between the first and second embodiments the same sanding block 30 could be used. A variation on this is a version with a swiveling curved attachment. It could substitute for both of these embodiments.

Figure 15:
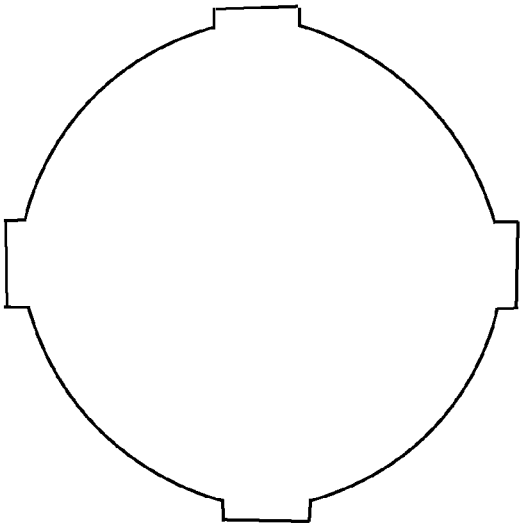
FIG. 15 is a bottom view of a sanding block compatible with the third embodiment sanding block holder.
Figure 16:
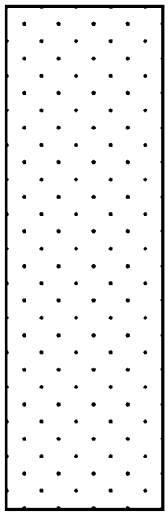
FIG. 16 is a side view of the block of FIG. 15.
Figure 17:
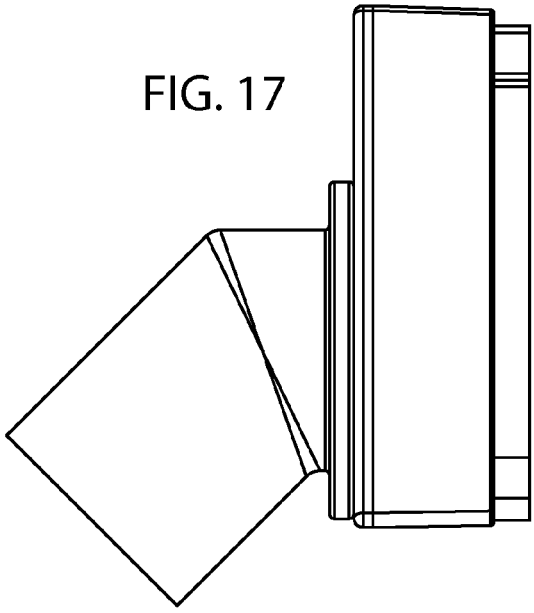
FIG. 17 is a side view of a fourth sanding block holder.
Figure 20:
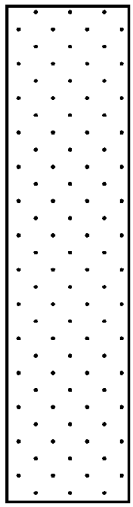
FIG. 20 is a side view of the sanding block of FIG. 19.
Figure 18:
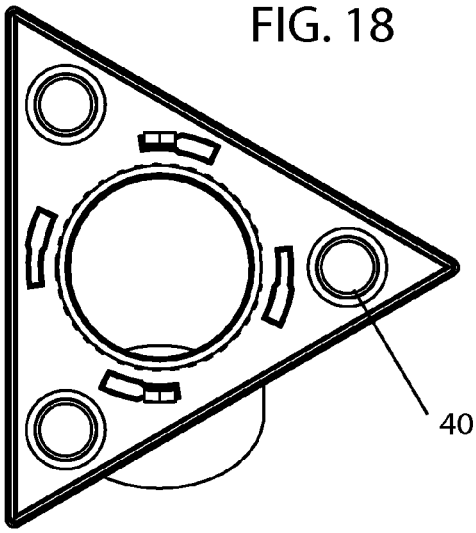
FIG. 18 is a bottom view of the holder of FIG. 17.
Figure 19:
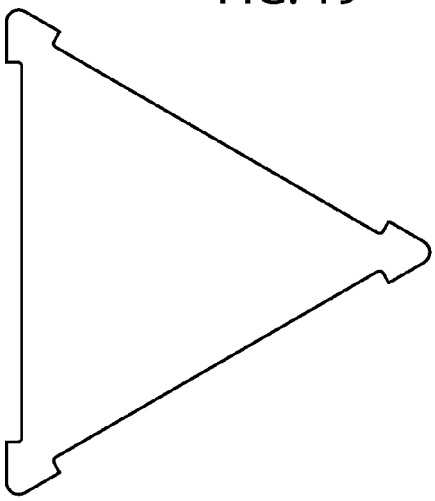
FIG. 19 is a bottom view of a sanding block suitable for use with the holder of FIG. 18.
Figure 21:
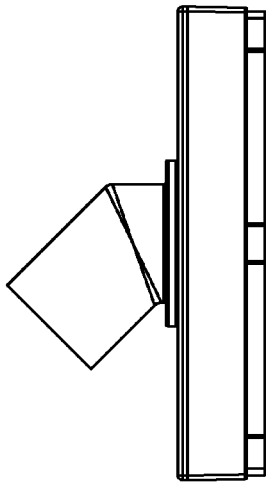
FIG. 21 is a side view of a fifth embodiment sanding block holder.
Figure 22:
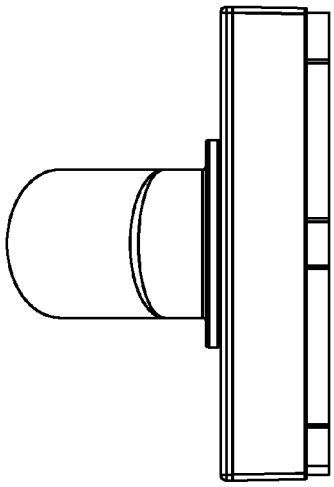
FIG. 22 is a side view of the fifth embodiment sanding block holder 90-degrees from the view of FIG. 21.
Figure 23:
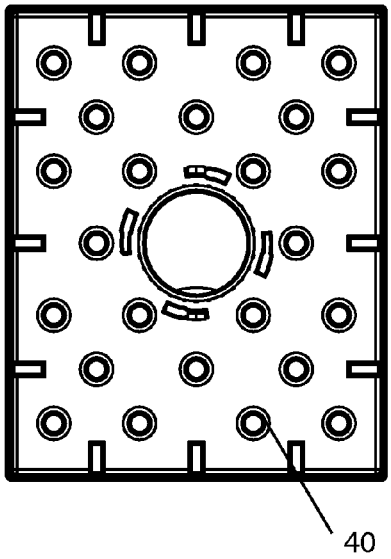
FIG. 23 is a bottom view of the fifth embodiment sanding block holder of FIG. 21.
Figure 24:
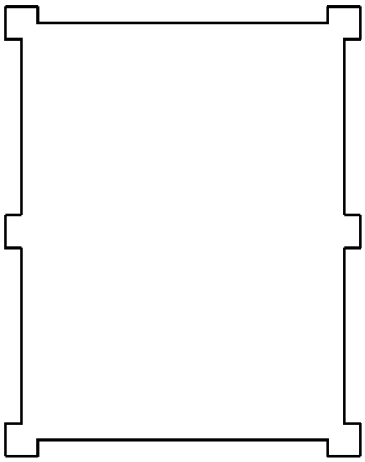
FIG. 24 is a bottom view of a sanding block suitable for use with the sanding block holder of FIG. 21.
Figure 25:
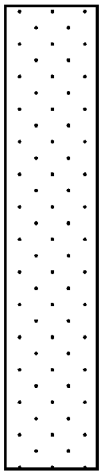
FIG. 25 is a side view of sanding block of FIG. 24.
Figure 26:
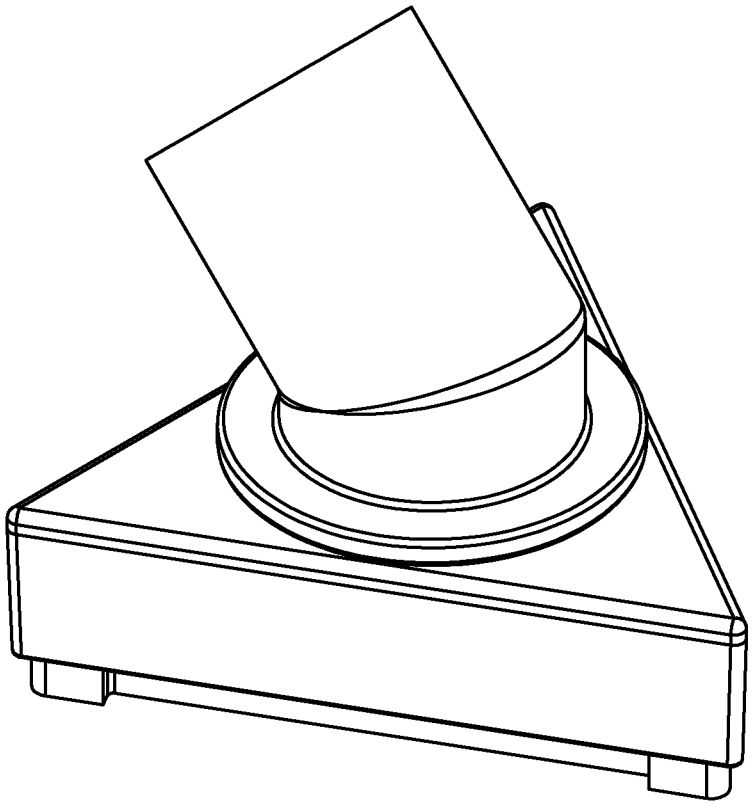
FIG. 26 is a top view of the holder of FIG. 17.

The third embodiment seen in FIGS. 13 and 14A with a version in 14B is circular. Its corresponding sanding block is seen in FIGS. 15 and 16. FIG. 14A shows the bottom of a version with a backing plate 41 while an alternate circular version's bottom is seen in FIG. 14B with several independent hollow protrusions 40 to support the sanding block The fourth embodiment is triangular. Seen in FIGS. 17,18 and 26, its sanding block is seen in FIGS. 19 and 20. The fifth embodiment seen in FIGS. 21, 22 and 23 is a smaller rectangle with sides of more similar length. Its complementary sanding block is seen in FIGS. 24 and 25. The circular, rectangular, and triangular forms can be thought of as sanding accessories and each have optimum uses on different shaped areas to be sanded.

Operation

To use the system of the first embodiment the sanding block 30 with the required complimentary shape to the housing 10 is placed into the housing. In this case the corners have a resilient interference fit that holds the block into the housing. Then, the sanding block is pressed square against the backing plate 5. A rigid portion of standard vacuum hose or pipe is fitted to a point 1 on the housing. The vacuum is turned on and the rigid portion of the vacuum pipe is used as a handle to sand drywall or other material. The negative pressure causes debris at the edges of the sanding block to be sucked away. Particularly in versions with individual protrusions, fine dust can also be drawn from the sanded surface through the body of the sanding block.

Of course other shapes are possible for other sanding applications. All of the diagramed embodiments have regular geometric shaped housing bottoms and accept a non-regular shaped sanding block. This can be reversed with a regular geometric shaped sanding block, say a rectangle, and in irregular shaped housing bottom that the rectangle fits into leaving the required gaps.

It is claimed:

1. A sanding system comprising:

a) a housing with an open bottom having an outermost perimetric structure with inner sidewalls and an orifice on at least one surface of the housing shaped and configured for ready coupling to a vacuum cleaner tube;

b) a generally planar sanding block of a shape to fit into the outermost perimetric structure of the bottom of the housing, the sanding block of a size and shape to retainingly abut portions of the inner sidewalls of the outermost perimetric structure without requirement for other retention structures and leaving a series of gaps between the block and the inner sidewalls and further, c) the system, when assembled for use, is such as to direct substantially all of any negative air pressure applied at the orifice to the gaps.

2. The sanding system of claim 1 where a path from the orifice to each respective gap is substantially direct.

3. A sanding system comprising:

a) a housing having an open bottom, the open bottom having outermost perimetric sidewalls, the outermost sidewalls collectively having an outer surface and an inner surface; the housing having a circular orifice shaped and sized for ready coupling to a vacuum cleaner tube;

b) a sanding block with a generally planar sanding surface and generally planar sidewalls, the sanding block sized and shaped to fit into the open housing bottom with the planar sidewalls of the sanding block directly abutting the inner surface of the outermost perimetric sidewalls only at portions thereof, resulting in a fit that retains the sanding block in the housing without requirement for other retention mechanisms; and the relative sizes and shapes of the open bottom and of the sanding block such as to engender along a perimeter a plurality of gaps between non-abutting regions of the inner surface and respective, adjacent regions of the sidewalls of the sanding block when the sanding block is in an operative position.

4. The sanding system of claim 3 where the portion of the perimeter having the gaps is at least 50% of the perimeter.

5. The sanding system of claim 3 where the portion of the perimeter having the gaps is at least 80% of the perimeter.

6. The sanding system of claim 3 where the sanding block is a foam sanding block.

7. The sanding system of claim 3 where the gaps are between about ⅛" and about ⅜".

8. The sanding system of claim 3 where the gaps are about 3/16".

9. A method of removing dust while hand sanding comprising:

applying negative pressure to the circular orifice of the sanding system of claim 3; and sanding a surface with the sanding block by manual motion of the housing while the negative pressure is being applied.

10. The sanding system of claim 3 where the planar surface of the sanding block is a regular geometric shape.

11. The sanding system of claim 1 where the regular geometric shape is a rectangle.

12. The sanding system of claim 3 where the circular orifice providing ready coupling to a vacuum cleaner tube is located and configured such that air pressure from a coupled vacuum is applied centrally relative to the open bottom.

13. The sanding system of claim 3 where the perimeter of the outermost sidewalls of the housing is a regular polygon.

14. The sanding system of claim 3 where the perimeter of the sidewalls of the sanding block is a regular polygon.

15. The system of claim 3 where the system, when assembled for use, is such as to direct substantially all of any negative air pressure applied at the orifice to the gaps.

* * * * *